US006347645B2

(12) United States Patent
Gurubatham et al.

(10) Patent No.: US 6,347,645 B2
(45) Date of Patent: Feb. 19, 2002

(54) FLUID DYNAMIC DIVERTER VALVE FOR AN APPLIANCE

(75) Inventors: Vincent Paulraj Gurubatham, St. Joseph, MI (US); Rocco Galli; Claudio Civanelli, both of Travedona Monate (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/801,378

(22) Filed: Mar. 7, 2001

Related U.S. Application Data

(60) Provisional application No. 60/206,756, filed on May 24, 2000.

(51) Int. Cl.[7] ..... F15C 3/00
(52) U.S. Cl. ..... 137/831; 137/833; 137/894
(58) Field of Search ..... 137/829, 833, 137/891, 892, 893, 894, 831

(56) References Cited

U.S. PATENT DOCUMENTS

| | | | | | |
|---|---|---|---|---|---|
| 3,053,276 | A | * | 9/1962 | Woodward | |
| 3,357,441 | A | * | 12/1967 | Adams | 137/831 |
| 3,444,710 | A | * | 5/1969 | Gaugler et al. | |
| 3,521,653 | A | * | 7/1970 | Becker et al. | 137/831 |
| 3,643,688 | A | * | 2/1972 | Meinert | 137/893 |
| 3,877,486 | A | * | 4/1975 | Merrell et al. | 137/831 |
| 3,942,559 | A | * | 3/1976 | Kranz et al. | 137/831 |
| 4,241,760 | A | | 12/1980 | Mon | 137/829 |
| 4,278,110 | A | | 7/1981 | Price et al. | 137/805 |
| 5,067,509 | A | * | 11/1991 | Hunter | 137/14 |
| 5,365,962 | A | | 11/1994 | Taylor | 137/14 |

* cited by examiner

*Primary Examiner*—A. Michael Chambers
(74) *Attorney, Agent, or Firm*—Thomas J. Roth; Robert O. Rice; Stephen Krefman

(57) ABSTRACT

A fluid dynamic diverter valve is provided which has a valve body with a fluid inlet zone communicating with a fluid diversion zone, which in turn communicates with a fluid outlet zone. In the fluid inlet zone there is at least one inlet for a fluid, at least one air inlet and a venturi passage for guiding the fluid as a jet. In a passage downstream of the venturi passage the air inlet communicates with the fluid jet exiting the venturi passage and the jet enters the diversion zone. Depending on whether the air inlet is blocked or not, the fluid jet either continues straight through the diversion zone to a first outlet from the valve body or, if the air stream is blocked, the jet is diverted to impinge upon a wall in the diversion chamber, the wall being arranged to be directed toward a different one of the outlet openings in the fluid outlet zone. A second (or more) air inlet might be provided and a third (or more) body outlet may be provided such that selective blocking of one of the air inlets will cause the fluid jet to be diverted in the diversion zone to a different one of the body outlet openings. A control may be provided in combination with the valve for controlling the air flow into the air inlets which may be in the form of a low power actuator. The diverter valve can be used in a wide variety of applications and has particular usefulness in a domestic appliance such as an automatic washer or dishwasher.

14 Claims, 3 Drawing Sheets

FIG. 4
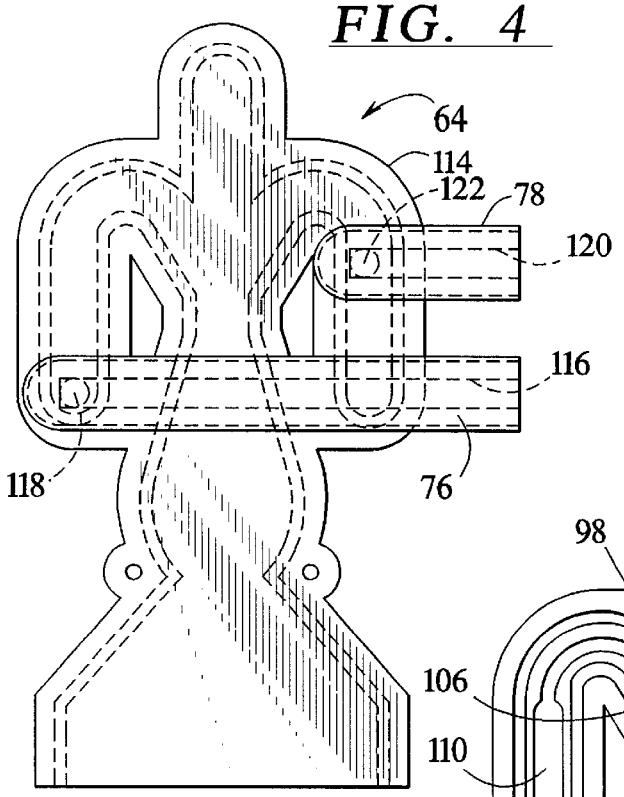
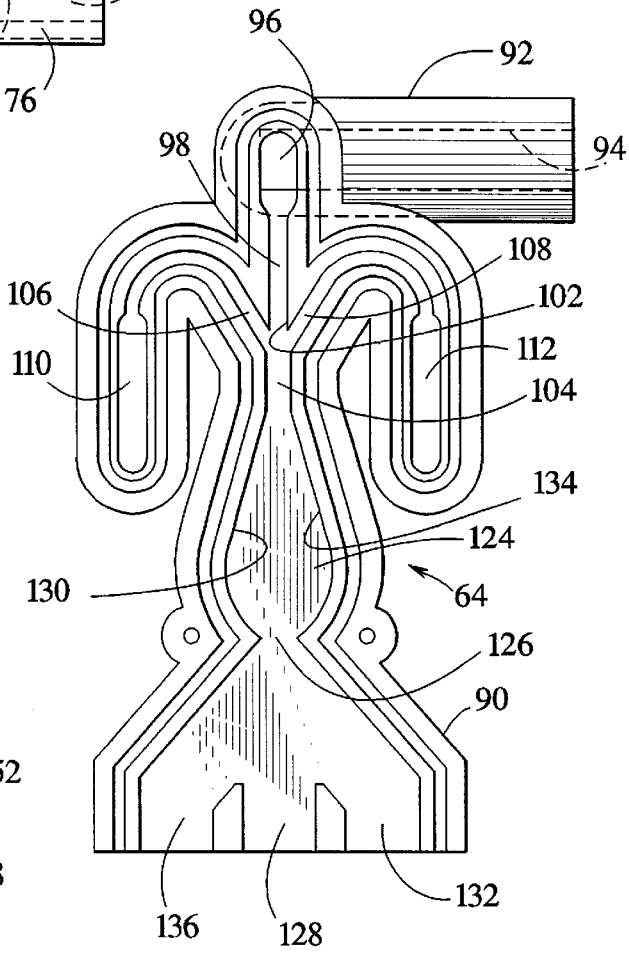
FIG. 3
FIG. 6
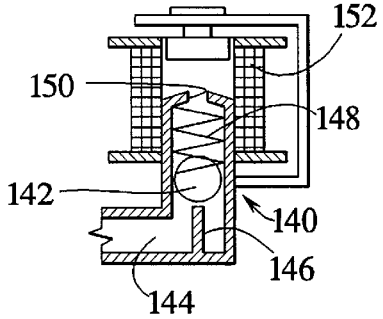

FLUID DYNAMIC DIVERTER VALVE FOR AN APPLIANCE

This application claims the benefit of provisional application No. 60/206,756, filed May 24, 2000.

BACKGROUND OF THE INVENTION

The present invention relates to diverter valves and in particular to a fluid dynamic diverter valve which can be used to divert a fluid stream, particularly in an appliance.

In domestic appliances, such as automatic clothes washers or dishwashers, various valves are used to divert a fluid stream, such as a water stream, through a number of dispensers, such as for delivery of detergent, bleach, fabric softeners, rinse agents, etc. Typically the diversion is accomplished by using a series of independent dedicated valves and conduits, usually actuated by solenoids. Water flows through conduits and is presented to one or more solenoid operated valves to be diverted to an appropriate dispenser or other point of utilization.

Oftentimes the amount of water presents a dynamic flow being controlled that is high enough to require sufficiently large and robust solenoids to overcome or withstand this flow. The use of extra conduits and multiple relatively high power solenoids is costly and it would be an advance in the art if there were provided a low cost alternative to diverting a fluid stream to multiple outlets.

SUMMARY OF THE INVENTION

The present invention provides a low cost alternative to divert a fluid stream to one of multiple outlets in a manner which is cost effective relative to the use of multiple relatively high power solenoids and conduits.

The present invention utilizes the fluid flow or dynamics of the fluid in order to divert the fluid flow to one of two or more different channels which can then be directed to appropriate outlets, dispensers or other points of utilization depending upon the particular application and/or appliance.

A fluid dynamic diverter valve is utilized which includes a fluid inlet zone, a fluid diversion zone and a fluid outlet zone.

The present invention is designed to operate under fluid pressures ranging from 0.311 bar (4.5 psi) to 5.51 bar (80 psi). Normally, in the industry in order to divert water from a single source multiple hoses and solenoids are used. The solenoids are bulky, expensive and their electrical code requirements add more cost and complexity. The use of extra conduits add more complexity and potential leakage problems as well. In the present invention, there are no additional conduits. The present invention provides for an integrated hose and vacuum break assembly as part of the molding, thus eliminating any potential for leakage.

In an embodiment of the invention, in the fluid inlet zone there is a fluid flow path which includes a venturi passage in communication with two air channels which introduce air to opposite lateral sides of the fluid stream exiting the venturi. Although the term "air" is used, this term should be understood herein to include any gas, however, in most instances ambient air will most likely be used. The fluid diversion zone comprises a chamber located downstream of the venturi outlet and which has shaped or oriented lateral side walls for receiving and guiding the fluid stream. The shaped or oriented walls of the chamber terminate at an outlet leading to the fluid outlet zone. The fluid outlet zone has three spaced outlet passages which are arranged to selectively receive fluid flow which has exited the diversion chamber in particular direction.

When a fluid flow is introduced into the venturi passage, a steady jet of fluid flows straight out of the exit of the venturi, straight through the diversion chamber and out through a center outlet passage of the fluid outlet zone. Air is aspirated through both air channels in equal amounts by operation of the venturi and the fluid jet remains centered and stable.

If one of the air channels is closed, thus preventing aspiration of air through that channel, an unsteady state occurs in the fluid jet being emitted from the venturi. This unsteady state causes the fluid to divert toward the lateral side wall corresponding to the closed air channel, thus causing the fluid jet to impinge upon and be guided by that particular wall. An end of the wall at the exit of the chamber may be curved and is directed toward one of the outlet passages so that the fluid jet will be directed to that passage.

If only the second air channel is closed, the fluid jet will be diverted to the lateral side wall corresponding to the second closed air channel and that wall is arranged to direct the fluid jet out of the chamber exit toward the third outlet passage.

The force required to close the air flow through either channel is very minimal, thus permitting the use of a low power and low cost actuator for controlling the opening or closing of the selected air channel. Various types of actuators can be used including wax motors, bi-metal actuators, leaf springs, electromagnetically operated actuations and low power solenoid actuators.

BRIEF DESCRIPTION OF THE DRAWINGS

FIG. 3 is an elevation view of a bottom half of a fluid dynamic diverter valve body embodying the principles of the present invention.

FIG. 4 is a plan view of a top half of a fluid dynamic diverter valve designed to mate with the bottom half illustrated in FIG. 3.

FIG. 6 is a schematic illustration of an actuator valve which can be utilized with the present invention.

DETAILED DESCRIPTION OF THE PREFERRED EMBODIMENTS

Figure 1:
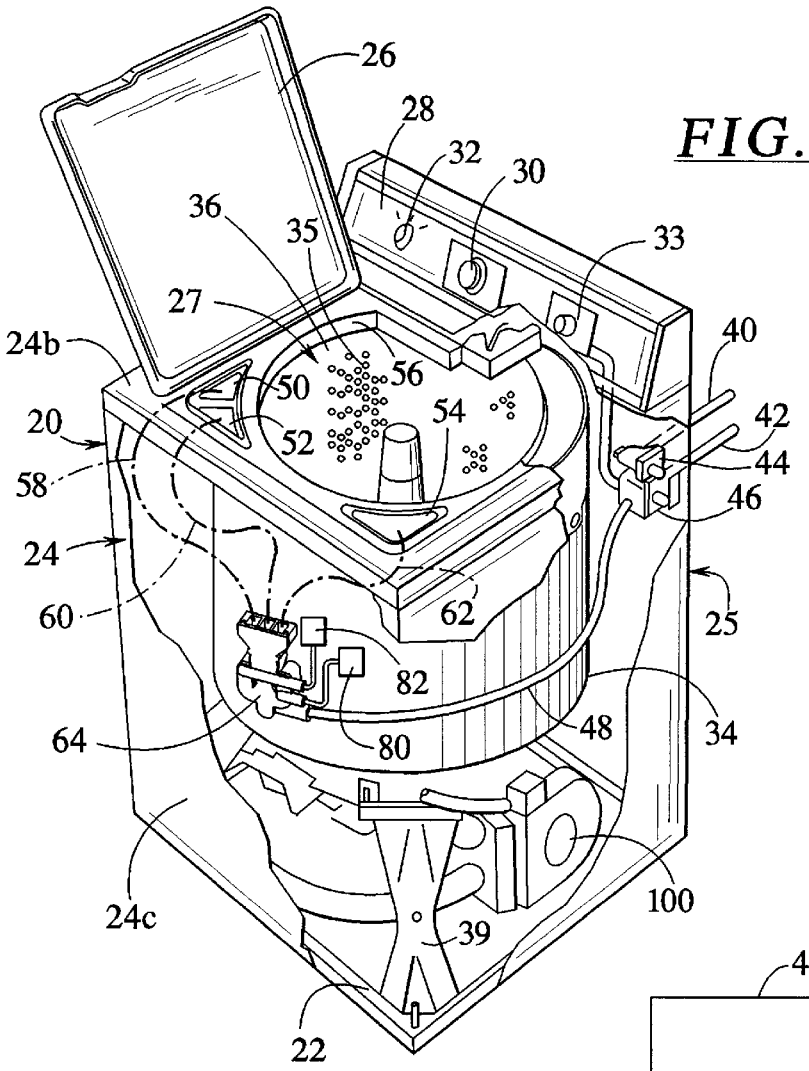
FIG. 1 is a perspective view of an automatic washer, partially cut away to illustrate various interior components and is illustrative of the type of appliance in which the present invention can be utilized.

FIG. 1 illustrates generally a washing machine of the automatic type, i.e. a machine having a pre-settable sequential control for operating a washer through a pre-selected program of automatic washing, rinsing and drying operations in which the present invention may be utilized. The present disclosure explains the use of the present invention in the environment of an automatic washer as a preferred embodiment although it should be understood that the present invention can be utilized in virtually any application where a fluid stream is to be diverted into one of a selected number of outlets. The fluid in an appliance is typically water, or water with some additive, however the present invention can be used with any fluid, that is, any liquid or gas or even air.

The machine 20 includes a frame 22 carrying panels 24 forming the sides 24*a*, top 24*b*, front 24*c* and back 24*d* of the cabinet 25 for the washing machine 20. A hinged lid 26 is provided in the usual manner to provide access to the interior or treatment zone 27 of the washing machine 20. The washing machine 20 has a console 28 including a timer dial or other timing mechanism and a temperature selector 32 as well as a cycle selector 33 and other selectors as desired.

Internally of the machine 20 described herein by exemplifications, there is disposed an imperforate fluid containing tub 34 within which is a spin wash basket 36 with perforations or holes 35 therein, while a pump 38 is provided below the tub 34. The spin basket 36 defines a wash chamber. A motor 100 is operatively connected to the basket 36 through a transmission to rotate the basket 36 relative to the stationary tub 34. All of the components inside the cabinet are supported by struts 39.

Water is supplied to the imperforate tub 34 by hot and cold water supply inlets 40 and 42. A hot water valve 44 and a cold water valve 46 are connected to manifold conduit 48. The manifold conduit 48 is interconnected to a plurality of wash additive dispensers 50, 52 and 54 disposed around a top opening 56 above the tub, just below the openable lid 26. As seen in FIG. 1, these dispensers are accessible when the hinged lid 26 is an open position. Dispensers 50 and 52 can be used for dispensing additives such as bleach or fabric softeners and dispenser 54 can be used to dispense detergent (either liquid or granular) into the wash load at the appropriate time in the automatic wash cycle. Each of the dispensers 50, 52 and 54 is supplied with liquid (generally fresh water) through separate dedicated conduits 58, 60, 62 respectively. The conduits are connected to a fluid dynamic diverter valve 64 described in detail below to which the water manifold conduit 48 is also connected.

Figure 2:
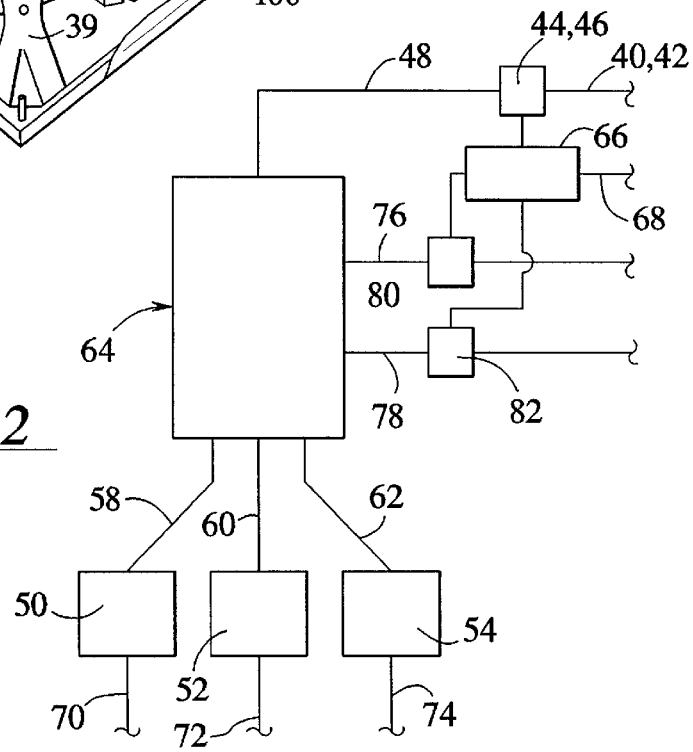
FIG. 2 is a schematic illustration of fluid flow paths and elements including an embodiment of a fluid dynamic diverter valve embodying the principles of the present invention.

An embodiment of the fluid dynamic diverter valve 64 and associated fluid conduits are illustrated in an isolated schematic view in FIG. 2. The fluid dynamic diverter valve 64 is supplied with fluid (typically water) through conduit 48 as supplied through valves 44 and 46 from conduits 40 and 42. Of course, any number of supply conduits can be combined through appropriate valves leading to a single supply conduit such as 48 as required by a particular installation and appliance.

The valves 44, 46 are operated by means of an appropriate control mechanism 66 which receives power from line 68. The fluid flow from conduit 48 enters the diverter valve 64 and is diverted, in a manner which will be described below, to one of the selected outlets leading to conduits 58, 60 and 62 which, for example, can lead to dispensers 50, 52 and 54. The dispensers may dispense directly into another space, such as a wash zone, or they may be connected to further outlet conduits 70, 72 and 74 as illustrated.

The fluid dynamic diverter valve 64 is also supplied with ambient air through a first air inlet channel 76 and a second air inlet channel 78. An actuator valve 80 is provided in line 76 to control the flow of air through line 76 through operation of the control 66 and an actuator valve 82 is supplied in line 78 to control the flow of ambient air through line 78. The actuator valve 82 is also controlled by control 66.

Figure 5:
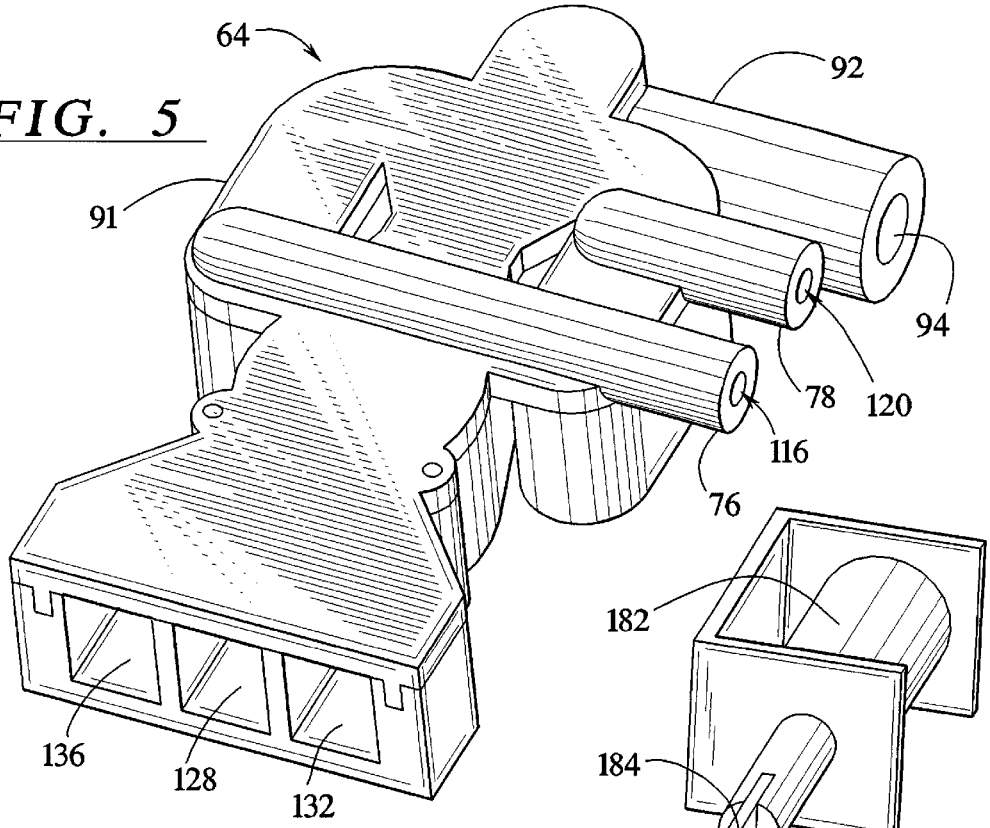
FIG. 5 is a perspective assembled view of the two halves of a fluid dynamic diverter valve as shown in FIGS. 3 and 4.

FIGS. 3 and 4 illustrate the internal geometry of a preferred embodiment of the fluid dynamic diverter valve 64 used in the present invention, while FIG. 5 illustrates an assembled view of the valve. FIG. 3 illustrates a bottom half 90 of a body 91 of the fluid dynamic diverter valve 64. A fluid inlet tube 92 is provided at one end which has an internal passage 94 for receiving a flow of fluid, for example, from conduit 48. The passage 94 opens into a small inlet chamber 96 positioned near a first end of the lower half 90. The inlet chamber communicates with a narrow passage 98 which forms a venturi for the inlet fluid flow. The venturi passage 98 has an outlet at 102 which opens into a slightly enlarged passage 104. Two other passages 106, 108 also lead into the slightly enlarged passage 104. A first chamber 110 communicates with the first side passage 106 and a second side chamber 112 communicates with the second side passage 108.

FIG. 4 illustrates a top half 114 of the body 91 of the fluid dynamic diverter valve 64 and is designed to overlie and mate with the bottom half 90 and to be sealed thereto (as illustrated in FIG. 5) such that enclosed and sealed passages exist in the space formed between the two halves.

A first air inlet channel 76 is provided which has an internal passage 116 leading to an inlet opening 118 which, when the two halves are placed together, communicates with the first side chamber 110, thus providing first side chamber 110 with a communication path through the first air inlet channel 76. The second air inlet channel 78 is also provided with an internal passage 120 which has an inlet opening 122 which, when the two halves 114, 90 are mated together, communicates with the second side chamber 112. This provides the second side chamber 112 with a communication path through the second air channel 78.

In operation, when fluid is introduced through the fluid inlet tube 92 to the fluid dynamic diverter valve 64, the fluid will enter the inlet chamber 96 and flow through the venturi channel 98 and out the outlet opening 102 into the slightly enlarged passage 104. As this occurs, air will be drawn in from the first side passage 106 from the first air channel 76 and air will be drawn in from the second side passage 108 through the second air channel 78 by the known venturi principle. Due to the symmetrical placement of the side air passages 106 and 108, the fluid jet from venturi passage 98 will continue in a straight line through passage 104 and will enter a relatively large diverter chamber 124. An end of the chamber 124 opposite from the slightly enlarged passage 104 is open as at 126 and fluid flow which is directed through the center of the diverter chamber 124 will continue in a straight line toward outlet passage 128.

However, if the air flow through the first air inlet channel 76 is blocked, such as by operation of the actuator valve 80, the fluid jet exiting the venturi passage 98 at outlet 102 will become unstable in the slightly enlarged passage 104 and the fluid jet will migrate and be diverted toward and impinge upon a side wall 130 associated with and located on the same side as the first side passage 106. This side wall 130 is first curved away from the center of the diverter chamber 124 and, at an end of the first sidewall 130 adjacent to the outlet opening 126, the first side wall 130 is directed toward a portion of an outlet zone where an outlet passage 132 is located. Thus, by closing off the first air channel 76, the fluid jet is caused to flow along the first side wall 130 of the diverter chamber 124 and is directed at diverter chamber outlet 126 toward the outlet opening 132.

On the other hand, if the second air inlet channel 78 is closed, such as by operation of the actuator valve 82, the fluid jet exiting the venturi passage 98 will be caused to impinge upon a second sidewall 134 of the diverter chamber 124. This second side wall 134 is located on the same side as the second side passage 108 which effectively has been blocked. The second sidewall 134 is curved first away from the center of the diverter chamber 110 and, at an end adjacent to the diverter chamber outlet opening 126, is directed toward a third outlet passage 136 such that fluid flowing along the second sidewall 120 will be directed toward the third outlet passage 136.

The three outlet passages 128, 132, 136 can be connected to appropriate conduits such as conduits 58, 60 and 62 shown in FIG. 1 leading to selected dispensers 50, 52 and 54, or other locations or points of utilization depending upon the particular installation into which the fluid dynamic diverter valve is being utilized.

Thus, the disclosed diverter valve 64 can be used to divert fluid flow to one of several outlets without the use of any moving parts in the valve 64 itself.

Although in the embodiment illustrated in FIGS. 3–5 two air channels are provided to the diverter valve and three outlet passages are provided, it will be understood to one of skill in the art that one air inlet and two outlets could be provided or more than two air inlets and more than three outlets could also be provided with appropriately shaped internal passages for the air inlets and the outlets. For example, four air inlet channels could be provided with side passages located at 90° to each other, rather than the two air inlet passages located at 180° from each other as in FIG. 3. In this arrangement one passage would be coming up out of the page and one passage would be going down into the page from the perspective as seen in FIG. 3. With such an arrangement, five outlet passages could be provided so that a single stream could be diverted into one of five selected outlets. Also, the particular geometry of the diverter chamber can be modified. What is important is that the side walls against which the fluid jet is diverted are arranged to direct the diverted jet toward a selected outlet opening. For example, as illustrated in FIG. 3, side wall 130 could continue to curve outwardly and be connected to outlet opening 136 rather than curving back inwardly to direct the fluid jet to outlet passage 132.

Further diversion of fluid streams can be effected by serially connecting additional fluid dynamic diverter valves to one or more of outlet passages 128, 132, 136 to further divide a fluid stream into other selected multiple outlets.

The operation of the fluid dynamic diverter valve 64 described above relies on the ability to close off a selected one of the air inlet channels. The air being drawn in through the air channels by the venturi jet is at a relatively low pressure, thus permitting a relatively low force to be used to close off the selected air channel. This permits the use of a relatively low power actuator which can be one of many different types of actuators as selected for a particular installation.

For example, in FIG. 6 there is illustrated a ball valve type actuator 140 in which a steel ball 142 is captured in an air flow passage 144. The ball is normally seated on a post 146 by operation of gravity or by operation of a spring 148 and is positioned below an opening 150 at an end of the air passage 144. Surrounding the opening 150 is an electromagnetic coil 152 which can be selectively energized to create a magnetic field which will attract the ball 142 causing the ball to move upwardly and to seal off the opening 150, thus blocking air flow. The air passage can continue from the interior of the coil 152 to the selected air channel to provide a flow of air when the ball is seated on the peg 146.

Figure 7:
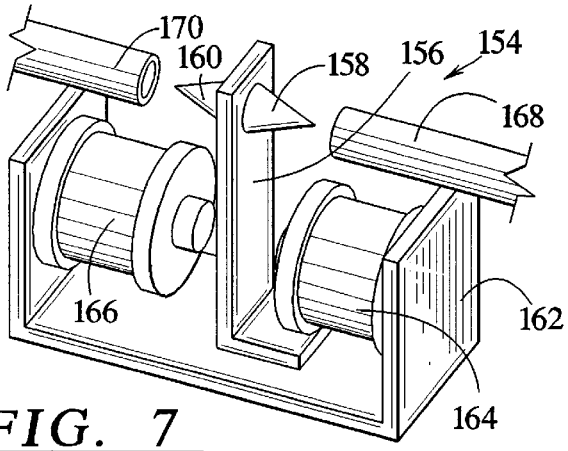
FIG. 7 is a schematic illustration of an actuator valve which can be utilized with the present invention.

FIG. 7 illustrates an actuator in the form of a leaf spring valve 154 in which a leaf spring 156 is provided with a pair of conical seal members 158, 160 on opposite sides of a free end of the leaf spring. A second end of the leaf spring is secured to a mounting bracket 162 which also carries two opposed electromagnetic coils 164, 166. The conical seal members 158, 160 are arranged adjacent to open ends of air conduits 168, 170 which normally are open at their ends. In operation, when the electromagnetic coil 164 is energized, the leaf spring 156 is attracted toward it, thus causing the conical seal member 158 to seat in the open end of the air conduit 168, effectively blocking the air passage. When the electromagnetic coil is de-energized, the leaf spring will return to the center position, thus opening the end of the air conduit 168 and permitting air to flow through air conduit 168. The second conical seal member 156 can be selectively used to close off the air conduit 170 in a similar manner. This leaf spring arrangement could also be replaced with a bi-metal member which can be caused to move one way or the other from a central location as is known.

Figure 8:
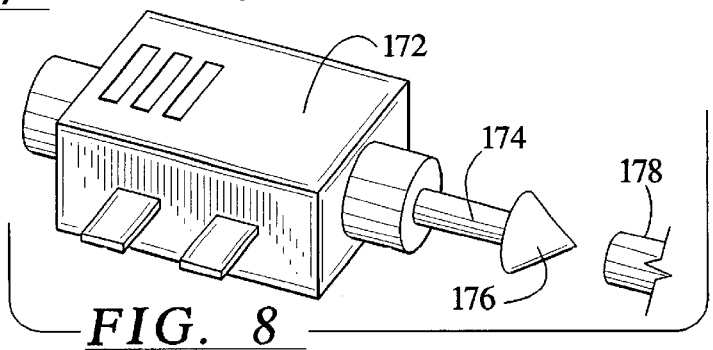
FIG. 8 is a schematic illustration of an actuator valve which can be used with the present invention.

FIG. 8 illustrates the use of a wax motor 172 as an actuator. When current is supplied to the wax motor, the wax will expand and a piston 174 with a conical seal member 176 will extend and be engaged into a open end of an air conduit 178. When current flow is terminated, the wax will contract and the piston 174 will be drawn back into the wax motor, thus releasing the seal member 176 from the air conduit 178, again allowing air flow into the air conduit. A low power solenoid can also be used in a manner essentially the same as the wax motor shown in FIG. 9.

Figure 9:
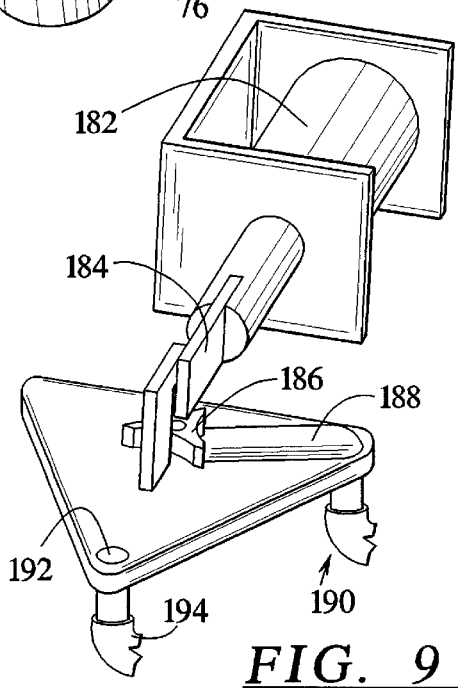
FIG. 9 is a schematic illustration of an actuator valve which can be utilized with the present invention.

FIG. 9 illustrates a ratcheting device which can be utilized as the actuator. A solenoid 182 has an extending arm 184 which can be used to selectively rotate a pawl 186 which, in turn, rotates a finger member 188 to any one of a selected number of positions depending upon the configuration of the pawl 186. Illustrated here are three positions, one as shown in full in which the finger 188 covers an opening leading to an air conduit 190. A second opening 192 leading to an air conduit 194 is open, thus allowing air flow through air conduit 194. The finger could selectively be moved to cover the second opening 192 rather than the opening leading to air conduit 190 to alternate which air conduit is closed. Alternatively, the finger could be rotated to a third position in which both openings leading to air conduits 190 and 194 are open. With this type of an actuator, any number of air conduits could be selectively closed, one at a time.

Other similar types of actuators could be utilized to control the opening into the air channels leading to the fluid dynamic diverter valve body 91 to divert the fluid stream entering the valve body to a selected one of a plurality of outlet openings from the valve body.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A fluid diverter comprising:

a fluid dynamic diverter valve having an inlet for a fluid stream, a passage for said fluid stream, first and second inlets for air streams communicating with said passage and three outlets for said fluid stream, and a control for selectively controlling a flow of air into said first and second air stream inlets, wherein said fluid stream is directed by said valve to a first of said outlets when air is permitted to flow into said first and second air stream inlets and said fluid stream is directed by said valve to a second of said outlets when air is prevented from flowing into said first air stream inlet, and said fluid stream is directed by said valve to a third of said outlets when air is prevented from flowing into said second air stream inlet.

2. A fluid diverter according to claim 1, wherein said passage includes a venturi passage for said fluid leading to an enlarged passage and said first and second air stream inlets communicate with opposite sides of said enlarged passage downstream of said venturi passage.

3. A fluid diverter according to claim 2, wherein said passage includes a further enlarged diverter chamber downstream of said enlarged passage with a first wall section positioned to direct a flow of fluid along said first wall to one of said outlets and a second wall section positioned to direct a flow of fluid along said second wall to a different one of said outlets.

4. A fluid diverter according to claim 1, wherein said control includes a valve actuator located adjacent air conduits leading to each of said first and second air stream inlets, said valve actuator being arranged to be able to selectively open or close an opening in said air conduits to permit or prevent air from flowing through said air conduits.

5. A fluid diverter according to claim 4, wherein said valve actuator comprises one of a ball valve, a leaf spring valve, a solenoid valve, a wax motor operated valve and a ratcheting valve.

6. A fluid diverter according to claim 1, wherein said fluid dynamic diverter valve contains no moving parts.

7. A fluid diverter valve comprising:

a fluid dynamic diverter valve body having a fluid inlet opening for receiving a flow of fluid, first and second air inlets for receiving first and second flows of air, and three body outlet openings for selectively discharging said flow of fluid from said body, said body having an internal passage leading from said fluid inlet to a venturi passage, an enlarged passage and a diverting chamber, said diverting chamber communicating with each of said outlet openings, said body further having a first side passage leading from said first air inlet to said enlarged passage, a second side passage leading from said second air inlet to said enlarged passage, with said first side passage being located on an opposite side of said enlarged passage from said second side passage, said diverting chamber being aligned with a first of said body outlet openings and having a first side wall shaped and arranged to lead to a second of said body outlet openings from said diverting chamber so as to direct fluid flowing along said first side wall towards said second of said body outlet openings and a second side wall shaped and arranged to lead to a third body outlet opening so as to direct fluid flowing along said second side wall towards said third body outlet openings.

8. A fluid diverter valve according to claim 7, wherein said valve body is formed of two mating parts, said passage being formed between said two parts when they are assembled together.

9. A fluid diverter valve according to claim 7, wherein said valve body is formed of two mating parts, said passages being formed in one of said parts to form open channels and being covered by the other of said parts to form enclosed passages.

10. A fluid diverter valve according to claim 9, further including first and second air inlet channels formed in said other of said parts and having an opening mating with respective ones of said first and second air inlets in said one of said parts.

11. A fluid diverter valve comprising:

a fluid dynamic diverter valve body having a fluid inlet zone communicating with a fluid diversion zone, which in turn communicates with a fluid outlet zone having three body outlet openings, said fluid inlet zone having at least one inlet for a fluid, first and second air inlets, a venturi passage for guiding said fluid as a jet, and a passage downstream of said venturi passage where said air inlets communicate with opposite sides of said fluid jet exiting said venturi passage, said fluid diversion zone being aligned with a first of said body outlet openings and having a fluid diversion chamber with a first wall leading to an opening directed towards said fluid outlet zone, and a second wall leading to said opening directed towards said fluid outlet zone, wherein said first wall is directed towards a second of said body outlet openings and said second wall is directed towards a third of said body outlet openings.

12. An appliance comprising:

a dynamic fluid diverter valve, a fluid inlet conduit leading to said valve to provide a flow of fluid to said valve, a first outlet fluid conduit leading from said valve to a first point of utilization, a second fluid outlet conduit leading from said valve to a second point of utilization, a third fluid outlet conduit leading from said valve to a third point of utilization, a first air inlet channel leading to said valve, a second air inlet channel leading to said valve, a control for selectively controlling a flow of air in said first and second air inlet channels, said valve being configured such that said flow of fluid will flow through said valve to said first fluid outlet conduit when air is permitted by said control to flow into said first and second air inlet channels and said flow of fluid will flow through said valve to said second fluid outlet conduit when air is prevented by said control from flowing into said first air inlet channel and said flow of fluid will flow through said valve to said third fluid outlet conduit when air is prevented by said control from flowing into said second air inlet channel.

13. An appliance according to claim 12, wherein said control includes a valve actuator, said valve actuator being arranged to be able to selectively open or close an opening in said air inlet channels to permit or prevent air from flowing through said air inlet channels.

14. An appliance according to claim 12, wherein said appliance comprises an automatic washer.

* * * * *